US011773473B2

(12) United States Patent
Yokota et al.

(10) Patent No.: US 11,773,473 B2
(45) **Date of Patent: *Oct. 3, 2023**

(54) HEAT-RESISTANT IR ALLOY

(71) Applicants: ISHIFUKU METAL INDUSTRY CO., LTD., Tokyo (JP); DENSO CORPORATION, Kariya (JP)

(72) Inventors: Shunsuke Yokota, Soka (JP); Yoshinori Doi, Soka (JP); Ryohei Akiyoshi, Kariya (JP); Ken Hanashi, Kariya (JP)

(73) Assignees: ISHIFUKU METAL INDUSTRY CO., LTD., Tokyo (JP); DENSO CORPORATION, Kariya (JP)

( * ) Notice: Subject to any disclaimer, the term of this patent is extended or adjusted under 35 U.S.C. 154(b) by 42 days.

This patent is subject to a terminal disclaimer.

(21) Appl. No.: 17/412,661

(22) Filed: Aug. 26, 2021

(65) Prior Publication Data

US 2022/0282358 A1 Sep. 8, 2022

Related U.S. Application Data

(63) Continuation-in-part of application No. 16/471,054, filed as application No. PCT/JP2017/045632 on Dec. 20, 2017, now Pat. No. 11,131,008.

(30) Foreign Application Priority Data

Dec. 22, 2016 (JP) ..... 2016-249860
Dec. 19, 2017 (JP) ..... 2017-242366

(51) Int. Cl.
*C22C 28/00* (2006.01)

(52) U.S. Cl.
CPC ..... *C22C 28/00* (2013.01)

(58) Field of Classification Search
None
See application file for complete search history.

(56) References Cited

U.S. PATENT DOCUMENTS 6,094,000 A 7/2000 Osamura et al.
10,153,621 B2 12/2018 Sumoyama et al.
(Continued)

FOREIGN PATENT DOCUMENTS

JP H09-7733 A 1/1997
JP 2005-533924 A 11/2005
(Continued)

OTHER PUBLICATIONS

Mar. 13, 2018 Search Report issued in International Patent Application No. PCT/JP2017/045632.
(Continued)

*Primary Examiner* — Brian D Walck
(74) *Attorney, Agent, or Firm* — Oliff PLC

(57) ABSTRACT

Provided is an Ir alloy which is excellent in high temperature strength while ensuring oxidation wear resistance at high temperature. The Ir alloy consists of: 7 mass % or more, and less than 10 mass % of Rh; 0.5 mass % to 5 mass % of Ta; 0 mass % to 5 mass % of at least one kind of element selected from among Co, Cr, and Ni; and Ir as the balance, wherein a total content of the Ta and the at least one kind of element selected from among Co, Cr, and Ni is 5 mass % or less.

2 Claims, 1 Drawing Sheet

TREATMENT TEMP.
1,000°C

TREATMENT TEMP.
1,100°C

TREATMENT TEMP.
1,200°C

(56) References Cited

U.S. PATENT DOCUMENTS

| | | | | |
|---|---|---|---|---|
| 10,938,186 | B2 * | 3/2021 | Akiyoshi | C22C 5/04 |
| 11,131,008 | B2 * | 9/2021 | Yokota | C22C 5/04 |
| 11,486,024 | B2 * | 11/2022 | Yokota | C22C 5/04 |
| 2009/0127996 | A1 | 5/2009 | Passman et al. | |
| 2009/0293995 | A1 | 12/2009 | Tanaka et al. | |
| 2014/0097739 | A1 | 4/2014 | Sumoyama et al. | |
| 2018/0166863 | A1 | 6/2018 | Sumoyama, Sr. et al. | |
| 2020/0321756 | A1 | 10/2020 | Akiyoshi et al. | |

FOREIGN PATENT DOCUMENTS

| | | | |
|---|---|---|---|
| JP | 2008-248322 | A | 10/2008 |
| JP | 2014-75296 | A | 4/2014 |
| KR | 2008-0071721 | A | 8/2008 |
| WO | 2004/007782 | A1 | 1/2004 |
| WO | 2008/013159 | A1 | 1/2008 |
| WO | 2016/189826 | A1 | 12/2016 |

OTHER PUBLICATIONS

Mar. 13, 2018 Written Opinion issued in International Patent Application No. PCT/JP2017/045632.

Jun. 25, 2019 International Preliminary Report on Patentability issued in International Patent Application No. PCT/JP2017/045632.

* cited by examiner

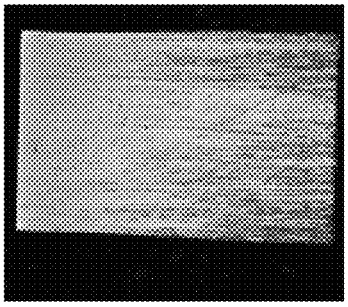
TREATMENT TEMP.
1,000°C
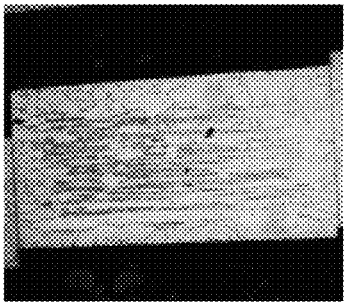
TREATMENT TEMP.
1,100°C
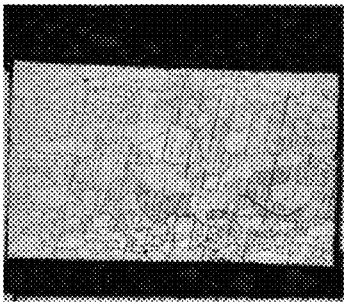
TREATMENT TEMP.
1,200°C

HEAT-RESISTANT IR ALLOY

This application is a Continuation-in-Part of application Ser. No. 16/471,054, filed Jun. 19, 2019, which is a national stage of PCT/JP2017/045632, filed Dec. 20, 2017, which claims priority to Japanese Application No. 2017-242366, filed Dec. 19, 2017, and Japanese Application No. 2016-249860, filed Dec. 22, 2016. The entire contents of the prior applications are hereby incorporated by reference herein in their entirety.

TECHNICAL FIELD

The present invention relates to a heat-resistant Ir alloy.

BACKGROUND ART

Various alloys have been developed as heat-resistant materials to be used for a crucible for high temperature, a heat-resistant device, a gas turbine, a spark plug, a sensor for high temperature, a jet engine, and the like. As major heat-resistant materials, there are given, for example, heat-resistant steel, a nickel-based superalloy, a platinum alloy, and tungsten. The heat-resistant steel, the nickel-based superalloy, the platinum alloy, and the like have solidus points of less than 2,000° C., and hence cannot be used at a temperature of 2,000° C. or more. Meanwhile, high-melting point metals, such as tungsten and molybdenum, suffer from severe oxidation wear in the air at high temperature. In view of the foregoing, an Ir alloy has been developed as a heat-resistant material having a high melting point and having high oxidation wear resistance.

In Patent Literature 1, there is disclosed an Ir—Rh alloy to be used for a noble metal chip of a spark plug for an internal combustion engine in which 3 wt % to 30 wt % of Rh is added in order to prevent volatilization of Ir at high temperature. There is described that, when such alloy is employed, a chip which is excellent in heat resistance at high temperature and improved in wear resistance is obtained.

CITATION LIST

Patent Literature

[PTL 1] JP 09-007733 A

SUMMARY OF INVENTION

Technical Problem

The Ir alloy to be used as the heat-resistant material is required to be further increased in high temperature strength while ensuring oxidation wear resistance at high temperature.

Thus, an object of the present invention is to provide an Ir alloy which is excellent in high temperature strength while ensuring oxidation wear resistance at high temperature.

Solution to Problem

According to one embodiment of the present invention, there is provided a heat-resistant Ir alloy consisting of:

7 mass % or more, and less than 10 mass % of Rh;

0.5 mass % to 5 mass % of Ta;

0 mass % to 5 mass % of at least one kind of element selected from among Co, Cr, and Ni; and Ir as the balance, wherein a total content of the Ta and the at least one kind of element selected from among Co, Cr, and Ni is 5 mass % or less.

Advantageous Effects of Invention

According to the present invention, the Ir alloy which is excellent in high temperature strength while ensuring oxidation wear resistance at high temperature can be provided.

BRIEF DESCRIPTION OF DRAWINGS

FIG. 1 are structure observation images in Example 1.

DESCRIPTION OF EMBODIMENTS

The present invention is directed to an Ir alloy consisting of:

7 mass % or more, and less than 10 mass % of Rh;

0.5 mass % to 5 mass % of Ta;

0 mass % to 5 mass % of at least one kind of element selected from among Co, Cr, and Ni; and Ir as the balance, wherein a total content of the Ta and the at least one kind of element selected from among Co, Cr, and Ni is 5 mass % or less.

Another aspect of the present invention is directed to an Ir alloy consisting of:

8 mass % or more, and less than 10 mass % of Rh;

0.5 mass % to 5 mass % of Ta;

0 mass % to 5 mass % of at least one kind of element selected from among Co, Cr, and Ni; and Ir as the balance, wherein a total content of the Ta and the at least one kind of element selected from among Co, Cr, and Ni is 5 mass % or less.

The above-mentioned "0 mass % to 5 mass % of at least one kind of element selected from among Co, Cr, and Ni" means that the Ir alloy may include 5 mass % or less of the at least one kind of element selected from among Co, Cr, and Ni, or may not include the at least one kind of element selected from among Co, Cr, and Ni. The content of Ta in the Ir alloy is preferably 0.7 mass % or more.

When the Ir alloy includes 5 mass % to 30 mass % of Rh, oxidative volatilization of Ir from a crystal grain boundary is suppressed in the air at high temperature or in an oxidizing atmosphere, and the oxidation wear resistance of the alloy is remarkably improved. When the content of Rh is less than 5 mass %, the oxidation wear resistance of the Ir alloy is insufficient. Meanwhile, when the content of Rh is more than 30 mass %, the oxidation wear resistance of the Ir alloy is satisfactory, but the melting point and the recrystallization temperature of the Ir alloy are reduced.

When an Ir—Rh alloy includes 0.5 mass % to 5 mass % of Ta, the strength of the alloy is increased through solid solution hardening due to Ta. In addition, such Ir—Rh alloy is also increased in recrystallization temperature, and hence softening at high temperature is suppressed. A composite oxide film between Ta and Rh is formed in the air at around 1,000° C., with the result that the oxidation wear resistance of the alloy is improved. When the content of Ta is less than 0.5 mass %, the strength of the Ir—Rh alloy is insufficient owing to reduction in solid solution hardening. Meanwhile, when the content of Ta is more than 5 mass %, the strength of the Ir—Rh alloy is further increased, but it becomes difficult to process the Ir—Rh alloy owing to reduction in plastic deformability. Besides, Ta is oxidized remarkably, and the oxidation wear resistance is reduced.

When an Ir—Rh—Ta alloy including 0.5 mass % to 5 mass % of Ta has an amount of Rh of 7 mass % or more, the oxidation wear resistance of the alloy is remarkably improved as compared to the case of having an amount of Rh of 5 mass %. That is, an Ir—Rh alloy including 7 mass % to 30 mass % of Rh, 0.5 mass % to 5 mass % of Ta, and Ir as the balance has satisfactory oxidation wear resistance.

It is considered that the reason why the alloy having an amount of Rh of from 7 mass % to 30 mass % has satisfactory oxidation wear resistance is that, as described above, the composite oxide film between Ta and Rh is formed in the air at around 1,000° C., with the result that the oxidation wear resistance of the alloy is improved. When the amount of Rh is 5 mass % or 6 mass %, it is considered that the effect exhibited by the formation of the composite oxide film between Ta and Rh is small owing to the insufficient amount of Rh.

When the Ir—Rh—Ta alloy includes 5 mass % or less of the at least one kind of element selected from among Co, Cr, and Ni, the strength of the alloy is further increased through solid solution hardening due to the at least one kind of element selected from among Co, Cr, and Ni (referred to as "element group A"). In addition, in the air at high temperature (e.g., 1,200° C. or more) or in an oxidizing atmosphere, the element group A is oxidized, and the resultant oxide is distributed in a grain boundary. With this, outward diffusion of Ir and subsequent oxidative volatilization of Ir are suppressed, and thus the oxidation wear resistance of the alloy can be improved. When the content of the element group A is more than 5 mass %, the oxide of the element group A is excessively formed, and the oxidation wear resistance is reduced contrarily. In addition, also the melting point of the alloy is reduced. The content of the element group A is preferably 0.3 mass % or more.

Each of the above-mentioned alloys is formed of a single-phase solid solution which is free of a second phase. Therefore, each of the alloys has satisfactory ductility, can be plastically formed into various shapes and dimensions through known warm working or hot working, and is also easily mechanically processed or welded.

EXAMPLES

Examples of the present invention are described. The compositions of alloys of Examples 1 to 37 and Comparative Examples 1 and 2 are shown in Table 1, and the test results are shown in Table 2. In addition, the compositions of alloys of Examples 38 to 53 and the test results thereof are shown in Table 3.

First, raw material powders (Ir powder, Rh powder, Ta powder, Re powder, Cr powder, Ni powder, and Co powder) were mixed at a predetermined ratio to produce mixed powder. Next, the resultant mixed powder was molded with a uniaxial pressing machine to provide a green compact. The resultant green compact was melted by an arc melting method to produce an ingot.

Next, the ingot thus produced was subjected to hot forging at 1,500° C. or more to provide a square bar having a width of 15 mm. The square bar was subjected to groove rolling at from 1,000° C. to 1,400° C., swaging processing, and wire drawing die processing to provide a wire rod of φ0.5 mm.

The processability was evaluated through the above-mentioned step of processing the ingot into the wire rod. A case in which a wire rod of φ0.5 mm was obtained was indicated by Symbol "○", and a case in which breakage occurred in the course of the processing and the wire rod was not obtained was indicated by Symbol "×".

The oxidation wear resistance was evaluated by a high-temperature oxidation test using each test piece cut out of the wire rod into a length of 0.8 mm. The high-temperature oxidation test was performed by setting the test piece in an electric furnace, and retaining the test piece in the air under the conditions of 1,000° C. or 1,200° C. for 20 hours. The oxidation wear resistance was defined as a mass change through the high-temperature oxidation test. A mass change $\Delta M$ (mg/mm$^2$) was determined by the following equation: $\Delta M=(M1-M0)/S$, where M0 represents the mass (mg) of the test piece before the test, M1 represents the mass (mg) of the test piece after the test, and S represents the surface area (mm$^2$) of the test piece before the test. In addition, the surface area S (mm$^2$) of the test piece was calculated from the dimensions of the test piece.

Considering that Ir had a characteristic of being liable to suffer from oxidation wear at around 1,000° C., the evaluation of the oxidation wear resistance was performed at 1,000° C., and was also performed as 1,200° C. in order to evaluate the oxidation wear resistance at higher temperature.

The evaluation of the oxidation wear resistance at 1,000° C. was performed as described below. An alloy having a value for $\Delta M$ of −0.10 or more was evaluated as having particularly satisfactory oxidation wear resistance (having a small oxidation wear amount), and was indicated by Symbol "○○" in Table 2. An alloy having a value for $\Delta M$ of less than −0.10 and −0.25 or more was evaluated as having satisfactory oxidation wear resistance, and was indicated by Symbol "○" in Table 2. An alloy having a value for $\Delta M$ of less than −0.25 was evaluated as having poor oxidation wear resistance (having a large oxidation wear amount), and was indicated by Symbol "×" in Table 2.

The evaluation of the oxidation wear resistance at 1,200° C. was performed as described below. An alloy having a value for $\Delta M$ of −0.20 or more was evaluated as having particularly satisfactory oxidation wear resistance (i.e., having a small oxidation wear amount), and was indicated by Symbol "○○" in Table 2. An alloy having a value for $\Delta M$ of less than −0.20 and −0.35 or more was evaluated as having satisfactory oxidation wear resistance, and was indicated by Symbol "○" in Table 2. An alloy having a value for $\Delta M$ of less than −0.35 was evaluated as having poor oxidation wear resistance (having a large oxidation wear amount), and was indicated by Symbol "×" in Table 2.

The solidus point was evaluated by increasing the temperature of each test piece up to 2,100° C. in an electric furnace in an Ar atmosphere, and observing the appearance and the sectional surface of the test piece. The sectional surface was polished, and the polished surface was subjected to Ar ion etching and then observed with a metallographic microscope (at a magnification of 100 times). A case in which no change was observed in the appearance and on the sectional surface was evaluated as having a solidus point of 2,100° C. or more (indicated by Symbol "○" in Table 2), and a case in which a melting mark was observed in the appearance or on the sectional surface was evaluated as having a solidus point of less than 2,100° C. (indicated by Symbol "×" in Table 2).

The recrystallization temperature was determined as described below. Each test piece was subjected to treatment at 1,000° C., 1,050° C., 1,100° C., 1,150° C., 1,200° C., 1,250° C., or 1,300° C. for 30 min in an electric furnace in an Ar atmosphere. A sectional surface of the test piece was polished, and the polished surface was subjected to Ar ion etching, and to structure observation with a metallographic microscope (at a magnification of 100 times). One test piece was subjected to heat treatment at one temperature.

As a result of the structure observation, a heat treatment temperature of the test piece at which a recrystallized grain was observed was defined as the recrystallization temperature of the alloy. For example, as shown in FIG. 1, when no recrystallized grain was observed at 1,000° C. and a recrystallized grain was observed at 1,100° C., the recrystallization temperature was defined as 1,100° C. The recrystallization temperature was evaluated as follows: a case of having a recrystallization temperature of 1,000° C. or less was indicated by Symbol "Δ" in Table 2, a case of having a recrystallization temperature of more than 1,000° C. and 1,100° C. or less was indicated by Symbol "○" in Table 2, and a case of having a recrystallization temperature of more than 1,100° C. was indicated by Symbol "○○" in Table 2.

The high temperature strength was evaluated by determining tensile strength by a tensile test at high temperature. As a test piece, a wire rod measuring φ0.5×150 mm was used after annealing at 1,500° C. The conditions of the tensile test were as follows: at a temperature of 1,200° C., in the air, and at a crosshead speed of 10 mm/min. The high temperature strength was evaluated as follows: a case of having a tensile strength of 200 MPa or less was indicated by Symbol "Δ" in Table 2, a case of having a tensile strength of more than 200 MPa and 400 MPa or less was indicated by Symbol "○" in Table 2, and a case of having a tensile strength of more than 400 MPa was indicated by Symbol "○○" in Table 2.

The overall evaluation was performed as described below. In each of the items of the oxidation wear resistance at 1,000° C. and 1,200° C., the recrystallization temperature, and the high temperature strength, Symbol "○○" had a score of 3 points, Symbol "○" had a score of 2 points, Symbol "Δ" had a score of 1 point, and Symbol "×" had a score of 0 points. A case of having a total score of 12 points was indicated by Symbol "Δ", a case of having a total score of from 8 points to 11 points was indicated by Symbol "B", and a case of having a total score of 7 points or less was indicated by Symbol "C". A case in which the processability or the solidus point was evaluated as poor (indicated by Symbol "×" in Table 2) was indicated by Symbol "D".

From the results shown in Table 2, it was confirmed that the alloys of Examples each had satisfactory oxidation resistance, and had a high solidus point, a high recrystallization temperature, and excellent high temperature strength, and thus had particularly preferred characteristics as a heat-resistant material.

From the fact that the oxidation wear resistance at 1,000° C. is evaluated as particularly satisfactory (indicated by Symbol "○○" in Table 2) in each of Examples 11 and 21 and the oxidation wear resistance at 1,000° C. is evaluated as satisfactory (indicated by Symbol "○" in Table 2) in each of Examples 22 and 23, it is revealed that the oxidation wear resistance at 1,000° C. becomes more satisfactory in the case of the addition of Ta than in the case of the addition of Re. In addition, through comparison between Example 11 and Example 22 and between Example 21 and Example 23, it is revealed that the recrystallization temperature and the high temperature strength become higher in the case of the addition of Ta than in the case of the addition of Re.

An effect exhibited by the addition of the element group A is considered. For example, through comparison between Example 7 and Example 11, it is revealed that the high temperature strength is increased by the addition of Cr. In addition, for example, through comparison among Example 6, Example 16, and Example 17, it is revealed that the high temperature strength is increased by the addition of Ni. In addition, for example, through comparison between Example 7 and Example 21, it is revealed that the high temperature strength is increased by the addition of Co.

In addition, the alloys of Examples were each able to be plastically formed even into a thin wire of φ0.5 mm, and it was indicated that products having various shapes were able to be easily obtained therefrom.

TABLE 1

| | | mass % | | | | | | |
|---|---|---|---|---|---|---|---|---|
| | Number | Ir | Rh | Ta | Re | Ni | Cr | Co |
| Example | 1 | Balance | 5 | 0.3 | — | — | — | — |
| | 2 | Balance | 5 | 0.3 | — | 4.7 | — | — |
| | 3 | Balance | 5 | 5 | — | — | — | — |
| | 4 | Balance | 10 | 0.3 | — | — | — | — |
| | 5 | Balance | 10 | 0.5 | — | — | — | — |
| | 6 | Balance | 10 | 1.5 | — | — | — | — |
| | 7 | Balance | 10 | 3 | — | — | — | — |
| | 8 | Balance | 10 | 3.5 | — | — | — | — |
| | 9 | Balance | 10 | 4 | — | — | — | — |
| | 10 | Balance | 10 | 5 | — | — | — | — |
| | 11 | Balance | 10 | 3 | — | — | 1 | — |
| | 12 | Balance | 10 | 1.5 | — | — | 1 | — |
| | 13 | Balance | 10 | 0.5 | — | — | 0.5 | — |
| | 14 | Balance | 10 | 0.5 | — | — | 3 | — |
| | 15 | Balance | 10 | 2.5 | — | — | 2.5 | — |
| | 16 | Balance | 10 | 1.5 | — | 0.5 | — | — |
| | 17 | Balance | 10 | 1.5 | — | 1.0 | — | — |
| | 18 | Balance | 10 | 3.5 | — | 0.5 | — | — |
| | 19 | Balance | 10 | 4.0 | — | 0.5 | — | — |
| | 20 | Balance | 10 | 4.0 | — | 1.0 | — | — |
| | 21 | Balance | 10 | 3 | — | — | — | 1.0 |
| | 22 | Balance | 10 | — | 3 | — | 1.0 | — |
| | 23 | Balance | 10 | — | 3 | — | — | 1.0 |
| | 24 | Balance | 10 | 1.5 | 1.5 | — | — | — |
| | 25 | Balance | 10 | 0.3 | — | 4.7 | — | — |
| | 26 | Balance | 27 | 0.5 | — | — | — | — |
| | 27 | Balance | 27 | 1.5 | — | — | — | — |
| | 28 | Balance | 27 | 3.0 | — | — | — | — |
| | 29 | Balance | 27 | 4.0 | — | — | — | — |
| | 30 | Balance | 27 | 1.5 | — | 0.5 | — | — |
| | 31 | Balance | 27 | 1.5 | — | 1.0 | — | — |
| | 32 | Balance | 27 | 4.0 | — | 0.5 | — | — |
| | 33 | Balance | 27 | 4.0 | — | 1.0 | — | — |
| | 34 | Balance | 30 | 0.3 | — | — | — | — |
| | 35 | Balance | 30 | 5.0 | — | — | — | — |
| | 36 | Balance | 30 | 0.3 | — | — | 4.7 | — |
| | 37 | Balance | 30 | 1.0 | 1.0 | 1.0 | 1.0 | 1.0 |
| Comparative Example | 1 | Balance | 10 | — | — | — | — | — |
| | 2 | Balance | 10 | 6 | — | — | — | — |

TABLE 2

| | Number | Processability | Solidus point | Oxidation wear resistance 1,000° C. | Oxidation wear resistance 1,200° C. | Recrystallization temperature ° C. | Evaluation high temp, strength | MPa | Evaluation | Overall evaluation |
|---|---|---|---|---|---|---|---|---|---|---|
| Example | 1 | ○ | ○ | ○ | ○ | 1,050 | ○ | 215 | ○ | B |
| | 2 | ○ | ○ | ○○ | ○○ | 1,100 | ○ | 340 | ○ | B |
| | 3 | ○ | ○ | ○○ | ○ | 1,200 | ○○ | 425 | ○○ | B |

TABLE 2-continued

| | Number | Processability | Solidus point | Oxidation wear resistance 1,000° C. | Oxidation wear resistance 1,200° C. | Recrystallization temperature ° C. | Evaluation high temp, strength | MPa | Evaluation | Overall evaluation |
|---|---|---|---|---|---|---|---|---|---|---|
| | 4 | ○ | ○ | ○○ | ○○ | 1,050 | ○ | 289 | ○ | B |
| | 5 | ○ | ○ | ○○ | ○○ | 1,050 | ○ | 202 | ○ | B |
| | 6 | ○ | ○ | ○○ | ○○ | 1,100 | ○ | 247 | ○ | B |
| | 7 | ○ | ○ | ○○ | ○ | 1,200 | ○○ | 322 | ○ | B |
| | 8 | ○ | ○ | ○○ | ○ | 1,200 | ○○ | 378 | ○ | B |
| | 9 | ○ | ○ | ○○ | ○ | 1,200 | ○○ | 393 | ○ | B |
| | 10 | ○ | ○ | ○○ | ○ | 1,250 | ○○ | 455 | ○○ | B |
| | 11 | ○ | ○ | ○○ | ○○ | 1,200 | ○○ | 387 | ○ | B |
| | 12 | ○ | ○ | ○○ | ○○ | 1,150 | ○○ | 305 | ○ | B |
| | 13 | ○ | ○ | ○○ | ○○ | 1,050 | ○ | 238 | ○ | B |
| | 14 | ○ | ○ | ○○ | ○○ | 1,100 | ○ | 346 | ○ | B |
| | 15 | ○ | ○ | ○○ | ○○ | 1,200 | ○○ | 498 | ○○ | A |
| | 16 | ○ | ○ | ○○ | ○○ | 1,100 | ○ | 345 | ○ | B |
| | 17 | ○ | ○ | ○○ | ○○ | 1,100 | ○ | 366 | ○ | B |
| | 18 | ○ | ○ | ○○ | ○ | 1,200 | ○○ | 387 | ○ | B |
| | 19 | ○ | ○ | ○○ | ○ | 1,200 | ○○ | 488 | ○○ | B |
| | 20 | ○ | ○ | ○○ | ○○ | 1,200 | ○○ | 520 | ○○ | A |
| | 21 | ○ | ○ | ○○ | ○ | 1,200 | ○○ | 391 | ○ | B |
| | 22 | ○ | ○ | ○ | ○ | 1,150 | ○○ | 341 | ○ | B |
| | 23 | ○ | ○ | ○ | ○ | 1,150 | ○○ | 355 | ○ | B |
| | 24 | ○ | ○ | ○○ | ○○ | 1,200 | ○○ | 380 | ○ | B |
| | 25 | ○ | ○ | ○○ | ○○ | 1,100 | ○ | 344 | ○ | B |
| | 26 | ○ | ○ | ○○ | ○○ | 1,050 | ○ | 240 | ○ | B |
| | 27 | ○ | ○ | ○○ | ○○ | 1,100 | ○ | 262 | ○ | B |
| | 28 | ○ | ○ | ○○ | ○○ | 1,150 | ○○ | 324 | ○○ | A |
| | 29 | ○ | ○ | ○○ | ○○ | 1,200 | ○○ | 380 | ○○ | A |
| | 30 | ○ | ○ | ○○ | ○○ | 1,100 | ○ | 254 | ○ | B |
| | 31 | ○ | ○ | ○○ | ○○ | 1,100 | ○ | 303 | ○ | B |
| | 32 | ○ | ○ | ○○ | ○○ | 1,200 | ○○ | 405 | ○○ | A |
| | 33 | ○ | ○ | ○○ | ○○ | 1,200 | ○○ | 477 | ○○ | A |
| | 34 | ○ | ○ | ○○ | ○○ | 1,050 | ○ | 330 | ○ | B |
| | 35 | ○ | ○ | ○○ | ○○ | 1,200 | ○○ | 462 | ○○ | A |
| | 36 | ○ | ○ | ○○ | ○○ | 1,100 | ○ | 353 | ○ | B |
| | 37 | ○ | ○ | ○○ | ○○ | 1,200 | ○○ | 431 | ○○ | A |
| Co. | 1 | ○ | ○ | ○ | ○○ | 1,000 | Δ | 175 | Δ | C |
| Example | 2 | x | — | — | — | — | — | — | — | D |

Next, the value of the oxidation wear resistance of each of Ir—xRh—3Ta alloys and Ir—xRh—0.5Ta alloys (x=5 mass % to 30 mass %) is shown in Table 3.

TABLE 3

| Example | mass % Ir | Rh | Ta | Oxidation wear resistance 1,000° C. | 1,200° C. |
|---|---|---|---|---|---|
| 38 | Balance | 5 | 0.5 | −0.159 | −0.220 |
| 39 | Balance | 6 | 0.5 | −0.113 | −0.209 |
| 40 | Balance | 7 | 0.5 | −0.093 | −0.194 |
| 41 | Balance | 8 | 0.5 | −0.090 | −0.168 |
| 42 | Balance | 9 | 0.5 | −0.090 | −0.150 |
| 43 | Balance | 10 | 0.5 | −0.089 | −0.138 |
| 44 | Balance | 20 | 0.5 | −0.083 | −0.095 |
| 45 | Balance | 30 | 0.5 | −0.080 | −0.080 |
| 46 | Balance | 5 | 3 | −0.129 | −0.313 |
| 47 | Balance | 6 | 3 | −0.108 | −0.243 |
| 48 | Balance | 7 | 3 | −0.060 | −0.230 |
| 49 | Balance | 8 | 3 | −0.035 | −0.223 |
| 50 | Balance | 9 | 3 | −0.039 | −0.218 |
| 51 | Balance | 10 | 3 | −0.045 | −0.214 |
| 52 | Balance | 20 | 3 | −0.070 | −0.114 |
| 53 | Balance | 30 | 3 | −0.072 | −0.095 |

For each of the Ir—xRh—3Ta alloys and the Ir—xRh—0.5Ta alloys, the alloy having an amount of Rh of 5% or 6% had a mass change (ΔM) at 1,000° C. of less than −0.100 mg/mm$^2$ and had a large mass change. Meanwhile, the alloy having an amount of Rh of from 7% to 30% had amass change (ΔM) of more than −0.100 mg/mm$^2$ and had a small mass change.

The invention claimed is:

1. An Ir alloy consisting of:

more than 5 mass %, and less than 10 mass % of Rh;

0.5 mass % to 5 mass % of Ta;

0 mass % to 5 mass % of Ni; and

Ir as the balance, wherein a total content of the Ta and Ni is 5 mass % or less.

2. An Ir alloy consisting of:

5 mass % or more, and less than 10 mass % of Rh;

0.5 mass % to 5 mass % of Ta;

0.3 mass % to 5 mass % of Ni; and

Ir as the balance, wherein a total content of the Ta and Ni is 5 mass % or less.

* * * * *